United States Patent [19]

Werneke et al.

[11] 4,293,406

[45] Oct. 6, 1981

[54] SYNERGISTIC PROMOTER COMBINATION FOR ZINC SULFIDE ORES

[75] Inventors: Michael F. Werneke, Orange, Conn.; James A. Jones, Viburnam, Mo.

[73] Assignee: American Cyanamid Company, Stamford, Conn.

[21] Appl. No.: 848,162

[22] Filed: Nov. 3, 1977

[51] Int. Cl.[3] ..... B03D 1/02

[52] U.S. Cl. ..... 209/166

[58] Field of Search ..... 209/166; 252/61

[56] References Cited

U.S. PATENT DOCUMENTS

| | | | |
|---|---|---|---|
| 2,449,984 | 9/1948 | Gibbs | 209/167 |
| 3,235,077 | 2/1966 | McGarry | 209/166 |
| 3,265,211 | 8/1966 | Roy | 209/166 |
| 3,341,135 | 9/1967 | Wilson | 209/166 X |
| 3,469,692 | 9/1969 | Freyberger | 209/166 |
| 3,779,250 | 4/1965 | Bunge | 209/166 |
| 4,040,950 | 8/1977 | Zipperian | 209/166 |

FOREIGN PATENT DOCUMENTS

| | | | |
|---|---|---|---|
| 461230 | 11/1949 | Canada | 209/166 |
| 455224 | 10/1936 | United Kingdom | 209/166 |
| 464335 | 6/1971 | U.S.S.R. | 209/166 |
| 533398 | 10/1976 | U.S.S.R. | 209/166 |

*Primary Examiner*—Robert Halper

*Attorney, Agent, or Firm*—Paul W. Leuzzi, II

[57] ABSTRACT

A combination of an ester of a mercapto carboxylic acid and an organic dithiol is a synergistic promoter for froth flotation of zinc sulfide ores.

2 Claims, No Drawings

SYNERGISTIC PROMOTER COMBINATION FOR ZINC SULFIDE ORES

CROSS-REFERENCE TO RELATED CASES

This case is related to application Ser. No. 848,163 filed on even date herewith now abandoned. This application relates to a promoter combination and the related application relates to a process of use of the promoter composition.

This invention relates to a novel composition of matter useful as a synergistic promoter in the recovery of zinc values in the froth flotation of zinc ores. More particularly, this invention relates to such a composition comprising from about 25 to 75 weight percent of an ester of mercapto carboxylic acid and, correspondingly, from about 75 to 25 weight percent of an organic dithiol.

In the production of high grade zinc oxide for pigments, the conventional procedure is to convert low grade zinc sulfide containing contaminants such as iron (as iron sulfide) and copper (both as copper sulfide and copper sulfate used in activating the zinc for flotation) to pure zinc and then burn the zinc to convert it to the oxide.

In those deposits of zinc mineral which contain little or no contaminating sulfides, the zinc may be converted directly to the oxide by fuming, provided that the copper used to activate it for flotation can be eliminated or at least reduced to a level which does not interfere in such processing.

In separate discoveries, it was previously found that two reagent types were capable of promoting zinc sulfide flotation without the use of copper sulfate to activate the zinc. In U.S. Pat. No. 3,235,077, issued Feb. 15, 1966 to McGarry et al., the use of certain esters of mercapto carboxylic acids was found effective. In U.S. Pat. No. 3,469,692, issued Sept. 30, 1969 to Freyberger, the use of certain organic dithiols was found effective. However, neither of these two reagents has proven completely satisfactory for the following reasons. The esters of mercapto carboxylic acids are powerful zinc promoters but tend to destroy or inhibit froth formation making it difficult to collect the promoted mineral in high recoveries. Although frothing is improved with reduced dosage of the esters of mercapto carboxylic acids, recovery decreases drastically with decreased dosage. Organic dithiols are moderate strength zinc promoters that result in unmanageable froths and again make recovery difficult.

In view of these deficiencies, there continues to exist the need for improved promoters for froth flotation of zinc minerals which do not require copper sulfate activation of the zinc values for flotation. Such a provision would fulfill a long-felt need and constitute a significant advance in the art.

In accordance with the present invention, there is provided a promoter combination for the froth flotation of zinc sulfide ores which comprises from about 25 to 75 weight percent of a water-soluble ester of a mercapto carboxylic acid and, correspondingly, from about 75 to 25 weight percent of an organic thiol.

The promoter combination of the present invention unexpectedly provides synergistic results. Use of the promoter combination provides higher recoveries than can be achieved with the individual promoters at equal total dosage and overcomes frothing problems encountered with the separate promoters. The combination promoter of the present invention also enables high zinc recovery to be achieved at lower total reagent dosage than can be achieved with the individual promoters. The promoter combination does not require the use of copper sulfate to activate the zinc for flotation.

The promoter combination of the present invention will contain as one component a water-soluble ester of a mercapto carboxylic acid of the general formula:

$$R-O-\overset{\overset{\displaystyle O}{\|}}{C}+C_nX+Y$$

wherein R is an alkyl or aryl-substituted alkyl radical, n is an integer such that the ester has sufficient water solubility to function as a collector when used in amounts up to about 0.5 pound per ton of ore, X is a total of 2 times n radicals of which at least one is an —SH radical (hydrosulfite) and at least one is a hydrogen, alkyl, aryl, aryl-substituted alkyl or halogen radical. Representative compounds of this type include isopropyl, isobutyl, n-amyl, benzyl, octyl, and iso-octyl thioglycolates ($\alpha$-mercaptoacetates), isopropyl $\beta$-mercaptopropionate and isobutyl thiolactate. This compound type will comprise from about 25 to 75 weight percent of the total promoter weight.

The promoter combination of the present invention will contain as another component an organic dithiol of the general formula:

$$HS-R-SH$$

wherein R is an organic moiety of from 6 to 18 carbon atoms. Among the useful aliphatic dithiols are included 1,6-hexanedithiol, 1,8-octanedithiol, 1,9-nonanedithiol, 1,12-dodecanethiol, 1.14-tetradecanethiol, 1,2-hexanedithiol, 1,2-tetradecanedithiol, and 2,5-dimethylhexane-2,4-dithiol. Among the useful alicyclic, aralkyl, alkaryl, or aryl dithiols are included dipentenedithiol (i.e., p-menthane-2,9-dithiol), ethyl cyclohexyl-2(or 3), 8-dithiol, phenyl-1,2-ethanedithiol, 1,2-cyclohexanedithiol, 1,4-di($\beta$-mercaptoethyl) benzene, naphthalene dithiols, 4,4'-methylene-dibenzenedithiol, and ethylidenedibenzenedithiol. This compound type will comprise, correspondingly, from about 75 to 25 weight percent of the total promoter weight.

In addition to the two essential promoter components described above, the promoter composition may contain such other components as may be desired provided they do not interfere with the synergistic results provided by the promoter combination. Optional components may include, for example, water or other water-miscible solvent for the promoter compounds to provide the combination in a convenient form for use. A suitable frother agent, such as polyethylene glycol, may also be a component of the promoter composition.

A particularly preferred promoter combination comprises p-menthane-2, 9-dithiol and iso-octylthioglycolate. A preferred percentage composition of this promoter combination is 40 weight percent p-methane-2, 9-dithiol and 60 weight percent octylthioglycolate. In use, the amount of promoter combination effecting zinc sulfide flotation will vary to some extent depending upon the amount of zinc in the ore and other factors, but is generally in the range of about 0.01 to 0.5 pounds of total promoter per ton of ore.

In processing a zinc ore using the promoter combination of the present invention, the ore is ground to flotation size, generally about 98% minus 48 mesh (Tyler standard) as in conventional processing. The ground ore is then subjected to froth flotation without the necessity of intermediate treatment for activation of the zinc sulfide. It is generally preferred to condition the ore for a short time interval before flotation, but the ore may be processed directly to the flotation operation. A frothing agent is used. After flotation for one to several minutes, the floated zinc sulfide is recovered by conventional means.

The invention is more fully illustrated by the examples which follow wherein all parts and percentages are by weight unless otherwise specified.

EXAMPLE 1

Four froth flotation runs were made using a sphalerite ore containing about 2.3% zinc using the following procedure. The ore was ground at 60% solids to flotation size. The ground ore was conditioned in a flotation cell at about 28% solids for 5 minutes with 0.05 lbs/ton of specified promoter and 0.12 lbs/ton of frother (polyethylene glycol). The froth was collected for 4½ minutes and the flotation products were then analyzed for zinc. Results and promoter usages are given in Table I.

TABLE I

| | SPHALERITE FLOTATION | | | |
|---|---|---|---|---|
| | Promoter Composition | | Tailing | Recovery |
| RUN | p-MDT[1] (%) | i-OTG[2] (%) | % Zn | % Zn |
| 1 | 100 | 0 | 0.170 | 93.07 |
| 2 | 50 | 50 | 0.120 | 95.13 |
| 3 | 35 | 65 | 0.120 | 95.18 |
| 4 | 20 | 80 | 0.170 | 93.16 |

NOTES:
[1]p-MDT = p-methane-1,9-dithiol
[2]i-OTG = iso-octylthiogylcolate

EXAMPLE 2

Seven froth flotation runs were made using a sphalerite ore containing an average of 2.16% zinc using the following procedure. The ore was ground at 66% solids to flotation size using 0.03 lbs/ton of promoter specified. The ground ore was then conditioned for an additional 4 minutes in a flotation cell at pH 8.2 with 0.04 lb/ton of specified promoter and 0.03 lb/ton of frother. The froth was collected for 2 minutes. The pulp was then conditioned for another minute with 0.02 lb/ton of specified promoter and 0.02 lb/ton of frother. The froth was then collected for an additional 2 minutes. The combined froth products were then assayed for zinc. Metallurgical results and promoters specified are given in Table II.

TABLE II

| | SPHALERITE FLOTATION | | | | |
|---|---|---|---|---|---|
| | Promoter Composition | | Assay % Zn | | |
| Run | p-MDT[1] % | i-OTG[2] % | Concentrate | Tailing | Recovery % Zn |
| 1 | 100 | 0 | 19.09 | 1.64 | 30.4 |
| 2 | 70 | 30 | 36.57 | 0.20 | 91.4 |
| 3 | 60 | 40 | 36.77 | 0.27 | 88.0 |
| 4 | 50 | 50 | 35.36 | 0.25 | 89.2 |
| 5 | 40 | 60 | 37.77 | 0.09 | 95.7 |
| 6 | 30 | 70 | 48.62 | 0.14 | 93.8 |
| 7 | 0 | 100 | 51.34 | 1.77 | 15.4 |

NOTES:
See Table I

It can be readily seen from the examples given that the promoter combination is superior to the individual components thereof.

When the procedure of Example 2 was followed substituting other esters of mercapto carboxylic acids and other organic dithiols for the appropriate compounds exemplified, the resulting combination promoter was superior to the individual components thereof at equal total dosage. The particular combination of mercapto carboxylic acid ester and organic dithiol exemplified, however, appears to represent the best mode contemplated.

We claim:

1. A promoter combination for the froth flotation of sphalerite ores which comprises from about 25 to 75 weight percent of an iso-octyl thioglycolate and, accordingly, from about 75 to 25 weight percent of p-menthane-2,9-dithiol.

2. The composition of claim 1 wherein said combination comprises 40 weight percent p-menthane-2, 9-dithiol and 60 weight percent iso-octyl thioglycolate.

* * * * *